US008439219B2

(12) United States Patent
Mineo

(10) Patent No.: US 8,439,219 B2
(45) Date of Patent: May 14, 2013

(54) CAP SEAL FOR CONTAINER SUCH AS DRUM, AND DOUBLY-SEALING APPARATUS OF CONTAINER SUCH AS DRUM USING THE SAME

(75) Inventor: Kinji Mineo, Osaka (JP)

(73) Assignee: Yamato System Company Ltd., Osaka (JP)

( * ) Notice: Subject to any disclaimer, the term of this patent is extended or adjusted under 35 U.S.C. 154(b) by 234 days.

(21) Appl. No.: 12/659,136

(22) Filed: Feb. 26, 2010

(65) Prior Publication Data

US 2010/0219190 A1 Sep. 2, 2010

(30) Foreign Application Priority Data

Feb. 27, 2009 (JP) ..... 2009-045755

(51) Int. Cl.
*B65D 41/48* (2006.01)
*B65D 55/02* (2006.01)

(52) U.S. Cl.
USPC ..... 220/266; 220/212; 220/780; 220/214; 220/601; 220/661; 340/572.1

(58) Field of Classification Search ..... 220/212, 220/214, 233, 257.1, 257.2, 284, 266, 270, 220/304, 601, 661, 780; 340/572.1
See application file for complete search history.

(56) References Cited

U.S. PATENT DOCUMENTS 3,987,929 A * 10/1976 Mineo ..... 220/257.1
2006/0283932 A1* 12/2006 Asp et al. ..... 235/375
2008/0309495 A1* 12/2008 Chisholm ..... 340/572.7

FOREIGN PATENT DOCUMENTS

JP 55-50119 11/1980

* cited by examiner

*Primary Examiner* — Anthony Stashick
*Assistant Examiner* — James N Smalley
(74) *Attorney, Agent, or Firm* — Edwards Wildman Palmer LLP; James E. Armstrong, IV; George N. Chaclas

(57) ABSTRACT

A cap seal and a doubly-sealing apparatus of a container such as a drum using the same, which execute a reliable sealing function of a cap part of the container such as the drum. Double sealing of the cap part of the container such as the drum due to the cap seal is fully performed despite various errors such as the difference in the curling external diameter of the cap part of the container.

6 Claims, 5 Drawing Sheets

(a)

(b)

(c)

CAP SEAL FOR CONTAINER SUCH AS DRUM, AND DOUBLY-SEALING APPARATUS OF CONTAINER SUCH AS DRUM USING THE SAME

This application clams priority, pursuant to 35 U.S.C. §119, to Japanese patent application no. 2009-045755 filed in Japan on Feb. 27, 2009, the entire disclosure of which is incorporated herein by this reference.

BACKGROUND OF THE INVENTION

1. Field of the Invention

The present invention relates to a cap seal for a container such as a drum, particularly, relates to a cap seal for a container such as a drum that is provided with an RFID tag or the like, and more particularly, relates to a cap seal for internal and external double sealing of a container such as a drum, and a doubly-sealing apparatus of a container such as a drum using the same.

2. Description of the Background Art

Conventionally, for example, when a plug with a gasket is screwed into a fixed flange of a cap part of a drum, fitting and applying a cap seal to the metal part, the cap part is sealed.

The inventor of the present invention previously proposed a device described in Japanese Utility Model Application Publication No. 55-50119 as the above-described cap seal for a container such as a drum.

According to a tightly-sealing apparatus of a cap part of a drum using a cap seal, which is described in Japanese Utility Model Application Publication No. 55-50119, an annular convex part for engagement with a nail-shaped cross section is integrally provided on an inner surface of a lower end of a drooping wall of a cap seal made of a synthetic resin, which is formed by a circular top and the drooping wall formed on a peripheral border of the circular top, and this cap seal is fitted to the cap part of the drum from the above to cover the cap part. Thereby, a lower textile part of the drooping wall is brought into contact with the upper surface of a washer or the upper surface of a top panel with pressure with the inner upper edge part of the annual convex part for engagement brought into contact with the exterior convex part with pressure.

However, there is a problem such that double sealing of the cap part of the container such as the drum is not sufficient even if the cap seal described in Japanese Utility Model Application Publication No. 55-50119 is used.

Generally, a curling external diameter (the external diameter after a press flange is placed) of the cap part of the drum is not defined by Japanese Industrial Standards (JIS). Then, the curling external diameter of the press flange is about 69.88 to 68.8 mm in an actual dimension, so there is a difference about 1 mm.

On the other hand, the curling external diameter of the curling part of the apparatus for placing the press flange to the top panel of the drum has also a measurement difference. Depending on the shape of a curling piece, there is a difference about 4.0 to 5.0 mm. Further, a sheet thickness of a rising cylinder portion of the top panel (the attachment portion of the press flange) also has a difference about 0.8 to 1.6 mm, and a sheet thickness of a folding front end (a carling part) of the press flange also has a difference about 0.8 to 1.6 mm.

Due to these various errors, there is a problem such that the double sealing of the cap part of the container such as the drum by the cap sealing is not sufficient.

In addition, new tags including an RFID tag are developed in recent years, and by using these tags, logistics such as a quality control of a product, transportation control, control of entering and dispatching from warehouse, and position management is carried out, however, the logistics by applying these tags to the container such as the drum and its content has not been executed at the present step, so the realization of the logistics by using these tags has been strongly expected.

SUMMARY OF THE INVENTION

The present invention has been made taking the foregoing problems into consideration and an object of which is to provide a cap seal for a container such as a drum and a doubly-sealing apparatus of a container such as a drum using the same. According to the above-described cap seal for a container such as a drum and the above-described doubly-sealing apparatus of a container such as a drum using the same, a reliable sealing function can be obtained, and despite various errors such as the difference in the curling external diameter of the cap part of the drum, the measurement difference in the curling external diameter of the curling part of the press flange placing apparatus, or the difference of the sheet thickness in the rising cylindrical portion of the top panel (the attachment portion of the press flange), and the difference of the sheet thickness in the folding front end (the curling part) of the press flange, it is possible to sufficiently obtain double sealing of the cap part of the container such as the drum by the cap sealing. Thereby, it is possible to certainly block ambient air (humidity and moisture) from the content of the container such as the drum so as to prevent a quality of the content from being damaged. Further, it is possible to open the cap seal very simply and reliably, and they can be handled very easily.

In addition, another object of the present invention is to provide a cap seal for a container such as a drum and a double sealing apparatus of a container such as a drum using the same, which can improve logistics of the content of the container such as the drum by using a tag such as an RFID tag and can carry out the quality control, the commodity management, the control of entering and dispatching from warehouse, and position management very promptly and certainly.

To achieve the above-described object, a cap seal of a container such as a drum according to a first aspect of the present invention is provided with a cap seal body made of an elastic material, which is fitted and applied to a cap part having an inner seal portion of a container such as a drum, wherein the cap seal body having a cap seal having a circular top wall; a concave groove for breakage that is provided on the circular top wall; an annular step portion continued to a peripheral portion of the circular top wall; and an annular drooping wall continued to an external periphery of the annular step portion; wherein the internal periphery surface of the annular step portion is formed as an upper inclined surface portion for engagement that is inclined downward and outward; on the inside of the annular drooping wall, a thick portion that is protruded inward is provided, and the internal periphery surface of the upper half part of the thick portion is formed as a lower inclined surface portion for engagement that is inclined downward and inward; an external narrow pressed portion for sealing having a cross section that is an approximate lateral V-shape is formed by the upper inclined surface portion for engagement that is inclined downward and outward on the inside of the annular step portion and the lower inclined surface portion for engagement that is inclined downward and inward located on the inside of the upper half part of the thick portion; the internal periphery surface of the lower half part of the thick portion is formed as a guide inclined surface portion for fitting and covering that is inclined downward and outward; when the cap seal being placed, by covering the cap part of the container such as the drum with the cap seal body, an upper end folding annular external convex part of a fixed cap is forcibly fitted into the inside of the external narrow pressed portion for sealing having the cross section that is the approximate lateral V-shape of the cap seal body so as to open the cross section that is the approximate lateral V-shape of the external narrow pressed portion for sealing; thereby, the upper end folding annular outward convex portion of the fixed cap is narrowly pressed at two contact points (P) and (Q) by a power of restitution of the elastic material by the outward and downward upper inclined surface portion for engagement and the inward and downward lower inclined surface portion for engagement of the external narrow pressed portion for sealing, so that the external sealing is carried out; and upon opening of the cap seal, the cap seal body is broken along a concave groove for breakage that is provided on the circular top wall of this to open the cap seal.

A second aspect of the present invention is the cap seal of the container such as the drum container according to the first aspect of the present invention, wherein a concave groove for breakage that is provided on the circular top wall of the cap seal body includes a main portion of the concave groove for breakage that seems a notched circle from a planar view and sub portions of the concave groove for breakage that are extended toward the annular step portion of the cap seal body from the opposite ends of the main portion of the concave groove for breakage.

A third aspect of the present invention is the cap seal of the container such as the drum according to the first or second aspect of the present invention; wherein the elastic material forming the cap seal body is a synthetic resin, elastomer, or a synthetic rubber.

A fourth aspect of the present invention is the cap seal of the container such as the drum according to any one of first to third aspect of the present invention; wherein the cap seal body is made of a synthetic resin, and on the inner surface of the circular top wall of the cap seal body, a tag such as an RFID tag having the information about the content of the container such as the drum stored is attached.

A fifth aspect of the present invention is the cap seal of the container such as the drum according to the fourth aspect of the present invention, wherein a convex part for attaching a tag is provided on the inner surface of the circular top wall of the cap seal body, and a tag such as an RFID tag having the information about the content of the container such as the drum stored is hanged by this convex part to be held on the inner surface of the circular top wall.

A sixth aspect of the present invention is the cap seal of a container such as the drum according to the fourth or fifth aspect of the present invention, wherein a tag is the RFID tag having the information about the content of the container such as the drum stored, the IC tag, the QR code display tag, or the bar code display tag.

A seventh aspect of the present invention is a doubly-sealing apparatus of a container such as a drum by using a cap seal for a container such as a drum according to any one of the first to sixth aspect of the present invention, wherein the annular step portion is continued to a peripheral portion of the circular top wall of the cap seal body, which is made of an elastic material and is engaged and applied to a cap part having an inner seal portion of a container such as a drum; the internal periphery surface of the annular step portion is formed as an upper inclined surface portion for engagement that is inclined downward and outward; on the inside of the annular drooping wall, which is continued to the external periphery surface of the annular step portion, a thick portion that is protruded inward is provided, and the internal periphery surface of the upper half part of the thick portion is formed as a lower inclined surface portion for engagement that is inclined downward and inward; an external narrow pressed portion for sealing having a cross section that is an approximate lateral V-shape is formed by the upper inclined surface portion for engagement that is inclined downward and outward on the inside of the annular step portion and the lower inclined surface portion for engagement that is inclined downward and inward located on the inside of the upper half part of the thick portion; the internal periphery surface of the lower half part of the thick portion is formed as a guide inclined surface portion for fitting and covering that is inclined downward and outward; by covering the cap part of the container such as the drum with the cap seal body, an upper end folding annular external convex part of a fixed cap is forcibly fitted into the inside of the external narrow pressed portion for sealing having the cross section that is the approximate lateral V-shape of the cap seal body so as to open the cross section that is the approximate lateral V-shape of the external narrow pressed portion for sealing; thereby, the upper end folding annular outward convex portion of the fixed cap is narrowly pressed at two contact points (P) and (Q) by a power of restitution of the elastic material by the outward and downward upper inclined surface portion for engagement and the inward and downward lower inclined surface portion for engagement of the external narrow pressed portion for sealing, so that the external sealing is carried out; and upon opening of the cap seal, the cap seal body is broken along a concave groove for breakage that is provided on the circular top wall of this to open the cap seal.

A cap seal of a container such as a drum according to a first aspect of the present invention is provided with a cap seal body made of an elastic material, which is fitted and applied to a cap part having an inner seal portion of a container such as a drum. The cap seal body is a cap seal having a circular top wall; a concave groove for breakage that is provided on the circular top wall; an annular step portion continued to a peripheral portion of the circular top wall; and an annular drooping wall continued to an external periphery of the annular step portion. The internal periphery surface of the annular step portion is formed as an upper inclined surface portion for engagement that is inclined downward and outward. On the inside of the annular drooping wall, a thick portion that is protruded inward is provided, and the internal periphery surface of the upper half part of the thick portion is formed as a lower inclined surface portion for engagement that is inclined downward and inward. An external narrow pressed portion for sealing having a cross section that is an approximate lateral V-shape is formed; the internal periphery surface of the lower half part of the thick portion is formed as a guide inclined surface portion for fitting and covering that is inclined downward and outward. By covering the cap part of the container such as the drum with the cap seal body when placing the cap seal, an upper end folding annular external convex part of a fixed cap is forcibly fitted into the inside of the external narrow pressed portion for sealing having the cross section that is the approximate lateral V-shape of the cap seal body so as to open the cross section that is the approximate lateral V-shape of the external narrow pressed portion for sealing. Thereby, the upper end folding annular outward convex portion of the fixed cap is narrowly pressed at two contact points (P) and (Q) by a power of restitution of the elastic material by the outward and downward upper inclined surface portion for engagement and the inward and downward lower inclined surface portion for engagement of the external narrow pressed portion for sealing, so that the external sealing is carried out. Upon opening of the cap seal, the cap seal body is broken along a concave groove for breakage that is provided on the circular top wall of this to open the cap seal. Therefore, there is an advantage such that the internal and external double sealing of the container such as the drum can be fully performed despite of various errors such as the difference in the curling external diameter of the cap part of the drum, the measurement difference in the curling external diameter of the curling part of the press flange (the fixed cap) placing apparatus, or the difference of the sheet thickness in the rising cylindrical portion of the top panel (the attachment portion of the press flange), and the difference of the sheet thickness in the folding front end (the curling part) of the press flange.

Therefore, according to the cap seal for the container such as the drum of the first aspect of the present invention, there is an advantage such that it is possible to certainly block ambient air (humidity and moisture) from the content of the container such as the drum so as to prevent a quality of the content from being damaged. In addition, when opening the cap part of the container such as the drum, the cap seal body is broken along a concave groove for breakage that is provided on the circular top wall of this to open the cap seal. Therefore, there is an advantage such that it is possible to open the cap seal very simply and reliably, they can be handled very easily, and a reliable sealing function can be obtained.

A second aspect of the present invention provides a cap seal for a container such as a drum according to the first aspect of the present invention. In the present cap seal, a concave groove for breakage that is provided on the circular top wall of the cap seal body is provided with a main portion of the concave groove for breakage that seems a notched circle from a planar view and sub portions of the concave groove for breakage that are extended toward the annular step portion of the cap seal body from the opposite ends of the main portion of the concave groove for breakage. According to the second aspect of the present invention, there is an advantage such that it is possible to open the cap seal very simply and reliably, they can be handled very easily, and a reliable sealing function can be obtained.

A third aspect of the present invention provides a cap seal for a container such as a drum according to the first or second aspect of the present invention. In the present cap seal, the elastic material forming the cap seal body is a synthetic resin, elastomer, or a synthetic rubber. According to the third aspect of the present invention, there is an advantage such that the internal and external double sealing of the container such as the drum can be fully performed, it is possible to certainly block ambient air (humidity and moisture) from the content of the container such as the drum so as to prevent a quality of the content from being damaged.

A fourth aspect of the present invention provides a cap seal for a container such as a drum according to any one of the first to third aspects of the present invention. In the present cap seal, the cap seal body is made of a synthetic resin, and on the inner surface of the circular top wall of the present cap seal body, a tag such as an RFID tag having the information about the content of the container such as the drum stored is attached. According to the fourth aspect of the present invention, there is an advantage such that it is possible to improve logistics of the content of the container such as the drum by using a tag such as an RFID tag and can carry out the quality control, the commodity management, the control of entering and dispatching from warehouse, and position management very promptly and certainly.

A fifth aspect of the present invention provides a cap seal for a container such as a drum according to the fourth aspect of the present invention. In the present cap seal, a convex part for attaching a tag is provided on the inner surface of the circular top wall of the cap seal body, and a tag such as an RFID tag having the information about the content of the container such as the drum stored is hanged by this convex part to be held on the inner surface of the circular top wall. According to the fifth aspect of the present invention, there is an advantage such that tags such as an RFID tag, an IC tag, a QR code display tag, or a bar-code display tag can be attached by one touch to the inner surface of the circular top wall of the cap seal body very simply, so that the cap seal can be manufactured simply and economically with an excellent workability.

A sixth aspect of the present invention provides a cap seal for a container such as a drum according to the fourth or fifth aspect of the present invention. In the present cap seal, a tag is the RFID tag having the information about the content of the container such as the drum stored, the IC tag, the QR code display tag, or the bar code display tag. According to the sixth aspect of the present invention, there is an advantage such that it is possible to carry out the quality control, the commodity management, the control of entering and dispatching from warehouse, and position management of the content of the container such as the drum very promptly and certainly by using these tags.

A seventh aspect of the present invention provides a doubly-sealing apparatus of a container such as a drum by using a cap seal for a container such as a drum according to any one of the first to sixth aspects of the present invention. The annular step portion is continued to a peripheral portion of the circular top wall of the cap seal body, which is made of an elastic material and is engaged and applied to a cap part having an inner seal portion of a container such as a drum. The internal periphery surface of the annular step portion is formed as an upper inclined surface portion for engagement that is inclined downward and outward. On the inside of the annular drooping wall, which is continued to the external periphery surface of the annular step portion, a thick portion that is protruded inward is provided, and the internal periphery surface of the upper half part of the thick portion is formed as a lower inclined surface portion for engagement that is inclined downward and inward. An external narrow pressed portion for sealing having a cross section that is an approximate lateral V-shape is formed by the upper inclined surface portion for engagement that is inclined downward and outward on the inside of the annular step portion and the lower inclined surface portion for engagement that is inclined downward and inward located on the inside of the upper half part of the thick portion. The internal periphery surface of the lower half part of the thick portion is formed as a guide inclined surface portion for fitting and covering that is inclined downward and outward. By covering the cap part of the container such as the drum with the cap seal body, an upper end folding annular external convex part of a fixed cap is forcibly fitted into the inside of the external narrow pressed portion for sealing having the cross section that is the approximate lateral V-shape of the cap seal body so as to open the cross section that is the approximate lateral V-shape of the external narrow pressed portion for sealing. Thereby, the upper end folding annular outward convex portion of the fixed cap is narrowly pressed at two contact points (P) and (Q) by a power of restitution of the elastic material by the outward and downward upper inclined surface portion for engagement and the inward and downward lower inclined surface portion for engagement of the external narrow pressed portion for sealing, so that the external sealing is carried out. Upon opening of the cap seal, the cap seal body is broken along a concave groove for breakage that is provided on the circular top wall of this to open the cap seal. Therefore, according to the invention according to the seventh aspect of the present invention, there is an advantage such that the internal and external double sealing of the container such as the drum can be fully performed despite of various errors such as the difference in the curling external diameter of the cap part of the drum, the measurement difference in the curling external diameter of the curling part of the press flange placing apparatus, or the difference of the sheet thickness in the rising cylindrical portion of the top panel (the attachment portion of the press flange), and the difference of the sheet thickness in the folding front end (the curling part) of the press flange.

Therefore, according to the invention of the doubly-sealing apparatus of the container such as the drum according to the seventh aspect of the present invention, there is an advantage such that it is possible to certainly block ambient air (humidity and moisture) from the content of the container such as the drum so as to prevent a quality of the content from being damaged.

In addition, when opening the cap part of the container such as the drum, the cap seal body is broken along a concave groove for breakage that is provided on the circular top wall of this to open the cap seal. Therefore, there is an advantage such that it is possible to open the cap seal very simply and reliably, they can be handled very easily, and a reliable sealing function can be obtained.

DESCRIPTION OF THE EMBODIMENTS

Next, the embodiments of the present invention will be described with reference to the drawings; however, the present invention is not limited to them.

Figure 2:
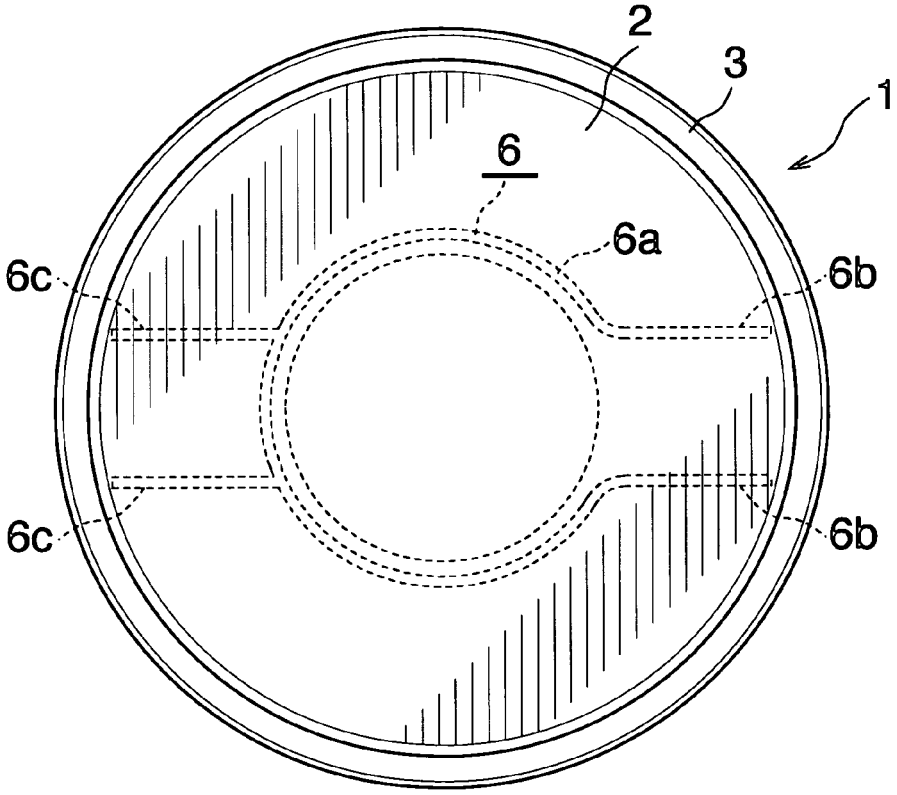
FIG. 2 is a view showing the whole cap seal on the plan view of FIG. 1.

In this specification, right, left, up, and down are based on FIG. 2; "left" means a left side of FIG. 2; "right" means a right side of FIG. 2; "front" means an upper side of FIG. 2; and "back" means a lower side of FIG. 2.

At first, with reference to FIGS. 1 to 4, a cap seal of a container such as a drum according to the present invention is provided with a cap seal body (1), for example, which is fitted and is applied to a cap part (30) having an inner seal portion of the drum and is made of an elastic material having a sealing property such as a synthetic resin, for example, a polyethylene resin, elastomer, or a synthetic rubber.

On the other hand, generally, two cap parts (30), which are small and large or the same sizes, are provided on a top panel (51) of the drum. In the drawings, the illustration of the smaller cap part among the small and large cap parts, or the illustration of another cap part among the same size two cap parts is herein omitted.

Figure 3:
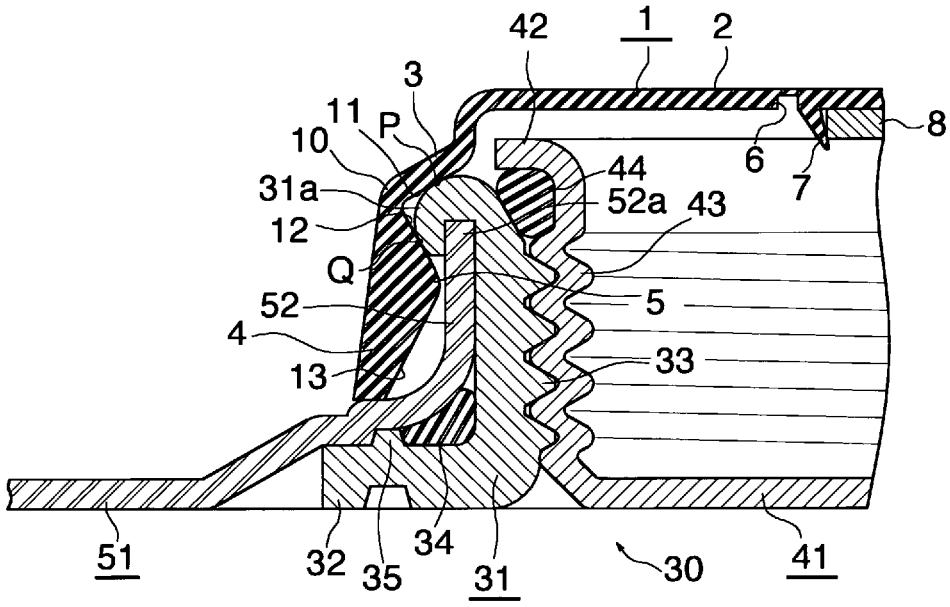
FIG. 3 is an enlarged longitudinal sectional view of substantial parts of a cap part of a drum with the cap seal according to the present invention placed thereon.
Figure 4:
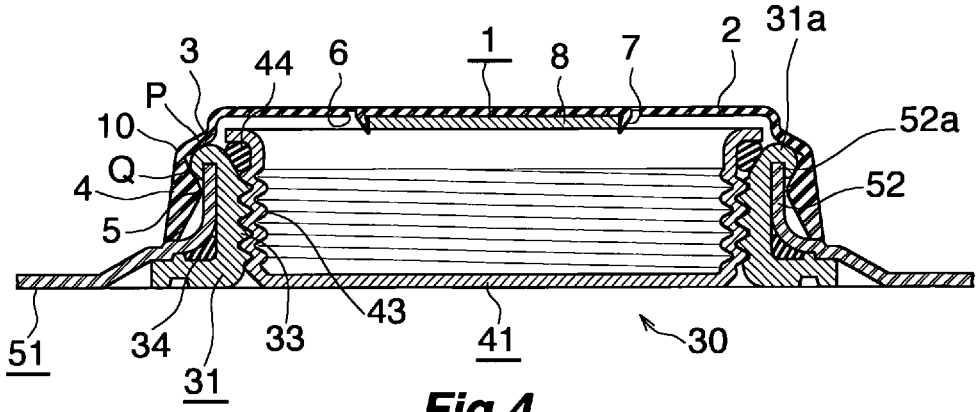
FIG. 4 is a view showing the whole cap part of the drum on the longitudinal sectional view of FIG. 3.

As shown in FIG. 3 and FIG. 4, on the cap part (30) of the top panel of the drum, a circular rising cylinder portion (52) is provided on the top panel (51), and on the middle part of the height of the circular rising cylinder portion (52), an annular step portion (53) is provided. Then, an inner screw type of fixed cap part (a press flange) (31) is put in the circular rising cylinder portion (52) of the top panel (51) from underneath, and its upper end portion is folded outward to be screwed by an upper end portion (52*a*) of the rising cylinder portion (52). Thereby, the upper portion of the flange (31) is engaged with the upper end portion (52*a*) of the top panel rising cylinder portion (52), and an upper end folding annular external convex portion (31*a*) of the fixed cap part (flange) (31) is formed.

The external periphery of a flange portion (32) on a lower edge of the press flange (31) is formed by an octagon shape from a planar view and this octagon is engaged with the internal periphery of a skirt portion for baffle of the octagon on the lower side of the annular step portion (53) of the top panel (51).

Then, an annular protruded portion (35) that is a circular shape from a planar view is placed on flange portion (32) with its upper part protruded by press working, and a gasket containing gap is formed between the annular protruded portion (35) and the flange (31). Into this gasket containing gap, a so-called gasket for flange (34) is fitted.

As this gasket for flange (34), it is desirable that a gasket made of a silicon rubber is attached by lining, however, beside this, an O ring and an annular gasket with an angular section may be used.

A plug (a cover) for a drum (41) has an inverted hut, and a gasket for a plug (44) is attached on the lower side of its upper end annular external convex edge part (42).

Then, a male screw portion (43) of the plug (41) with this gasket for a plug (44) is screwed into a female screw portion (33) within the flange (31), and the gasket for a plug (44) is attached firmly to the internal periphery surface of the upper end folding portion across the entire circumference. In such a manner, the cap part (30) of the drum is sealed.

In this way, the cap part (30) of the drum serves as a so-called inner seal by these gasket for flange (34) and gasket for a plug (44).

The cap seal of the drum according to the present invention serves as an outer seal fitted and applied to the above-described cap part (30) having the inner seal portion after sealing the top panel (51) of the drum.

Figure 1:
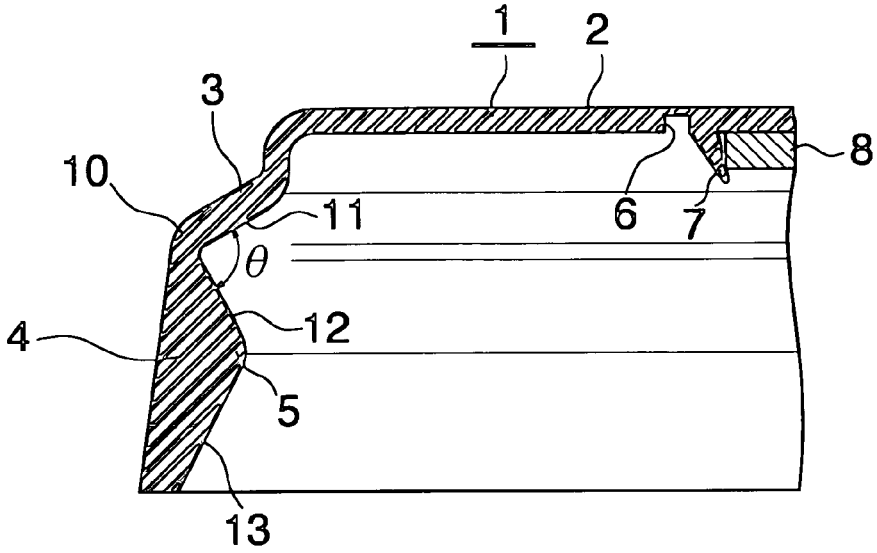
FIG. 1 is an enlarged longitudinal sectional view of substantial parts of a cap seal according to the present invention.

As illustrated in detail in FIG. 1 and FIG. 2, the cap seal body (1) made of the elastic material of the cap seal of the drum according to the present invention has a circular top wall (2), a concave groove for breakage (6) that is provided on the circular top wall (2), an annular step portion (3) that is continued to a peripheral edge portion of the circular top wall (2), and an annular drooping wall (4) that is continued to the external peripheral edge of the annular step portion (3), respectively.

Then, the internal periphery surface of the annular step portion (3) of the cap seal body (1) is formed as an upper inclined surface portion for engagement (11) that is inclined downward and outward, a thick portion (5) that is protruded inward on the inside of the annular drooping wall (4). The internal periphery surface of the upper half part of the thick portion (5) is formed as a lower inclined surface portion for engagement (12) that is inclined downward and inward, and an external narrow pressed portion for sealing (10) having the cross section that is the approximate lateral V-shape is formed by the upper inclined surface portion for engagement (11) that is inclined downward and outward within the annular step portion (3) and the lower inclined surface portion for engagement (12) that is inclined downward and inward within the upper half part of the thick portion (5), and the internal periphery surface of the lower half part of the thick portion (5) is formed as a so-called folding fan shaped guide inclined surface portion (13) for fitting and covering shaped in an inverted taper, which is inclined downward and outward. Since such a guide inclined surface portion (13) is provided, the annular drooping wall (4) of the cap seal body (1) is formed so as to be easily fitted to the cap part (30) of the drum from above.

As shown in FIG. 2, on the circular top wall (2) of the cap seal body (1) of the cap seal according to the present invention, a concave groove for breakage (6) is provided with a main portion of the concave groove for breakage (6*a*) that seems a notched circle from a planar view and sub portions of the concave groove for breakage (6*b*) that are extended in parallel from the opposite ends to the right side of the main portion of the concave groove for breakage (6*a*).

Then, according to the present embodiment, also on an arc portion on the left side of the main portion of the concave groove for breakage (6*a*) that is formed in a notched circle from a planar view and is provided on the circular top wall (2) of the cap seal body (1), two auxiliary portions of the concave groove for breakage (6*c*) that are extended in parallel to the left side from this arc portion.

Figure 5:
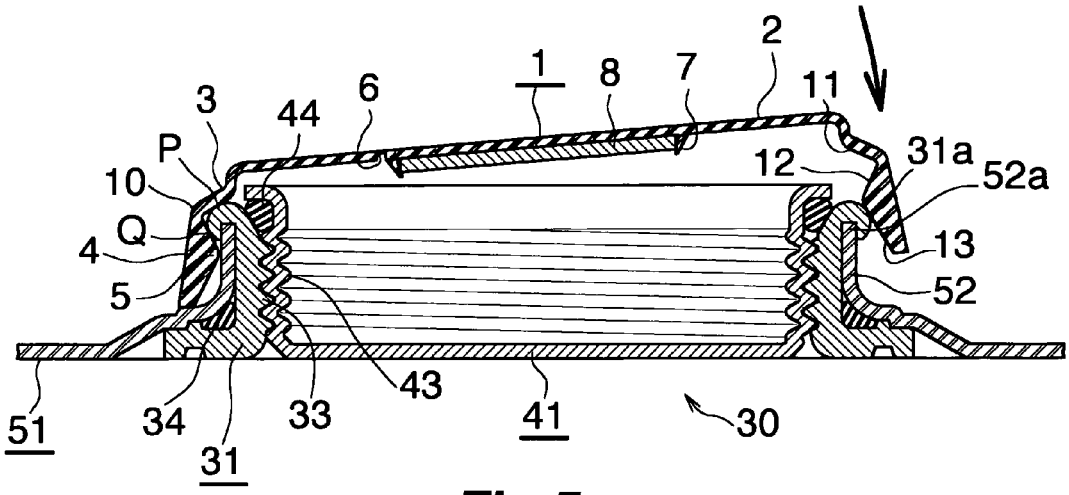
FIG. 5 is a longitudinal sectional view of the whole cap part showing the state just before the cap seal according to the present invention is placed to the cap part of the drum.

As shown in FIG. 5, when placing the cap seal according to the present invention, at first, one end portion of the cap seal body (1) is fitted and applied to the end portion on the same side as the above end portion of the cap seal body (1) of the cap part (30) of the drum from the side. In this case, to the inside of a narrow pressed portion for external seal (10) having the cross section that is the approximate lateral V-shape of the cap seal body (1), an upper end folding annular external convex part (31*a*) of a fixed cap (a flange) (31) is fitted so as to open the cross section that is the approximate lateral V-shape of the narrow pressed portion for external seal (10).

Subsequently, other end portion of the cap seal body (1) is strongly pressed from above in an arrow direction shown on the right side of FIG. 5 so as to be fitted and applied to the end portion on the same side as the arrow direction of the cap part (30) of the drum.

Here, the internal diameter of the front end portion within the thick portion (5) that is protruded inward on the inside of the annular drooping wall (4) is set so as to be smaller than the external diameter of the cap part (30) of the drum, and the thick portion (5) of the annular drooping wall (4) is opened outward once by strong presser in an arrow direction of other end portion of the cap seal body (1) so that the guide inclined surface portion (13) for fitting and covering of the thick portion (5) follows the end portion on the side same as the arrow direction, and further, by strongly pressing other end portion of the cap seal body (1) in the arrow direction, the front end portion inside of the thick portion (5) crosses the end portion on the same side of the cap part (30) of the drum. Thereby, the thick portion (5) of the annular drooping wall (4) is restored to the original state, and the upper end folding annular external convex part (31*a*) of the fixed cap (a flange) (31) is forcibly fitted to the inside of the narrow pressed portion for external seal (10) having the cross section that is the approximate lateral V-shape of the cap seal body (1) so as to open the cross section that is the approximate lateral V-shape of the narrow pressed portion for external seal (10).

Thus, as shown in FIG. 3 and FIG. 4, the upper end folding annular external convex part (31*a*) of the fixed cap (31) is narrowly pressed at two contact points (P) and (Q) by a power of restitution of the elastic material by the outward and downward upper inclined surface portion for engagement (11) and the inward and downward lower inclined surface portion for engagement (12) of the external narrow pressed portion for sealing (10), so that the external sealing is carried out.

Further, after the cap seal according to the present invention is placed, the lower end of the annular drooping wall (4) of the cap seal body (1) is brought into contact with the upper surface of the annular step portion (53) of the top panel rising cylinder portion (52) across the entire circumference, so that the sealing function by the cap seal is certainly executed.

Thus, according to the cap seal of the drum of the present invention, the internal and external double sealing of the drum can be fully performed despite of various errors such as the difference in the curling external diameter of the cap part (30) of the drum, the measurement difference in the curling external diameter of the curling part of the press flange placing apparatus (not shown), or the difference of the sheet thickness in the rising cylindrical portion of the top panel (the attachment portion of the press flange) (52), and the difference of the sheet thickness in the folding front end (the curling part) (31*a*) of the press flange (31).

Therefore, according to the cap seal of the drum of the present invention, it is possible to certainly block ambient air (humidity and moisture) from the content of the container so as to prevent a quality of the content from being damaged.

Here, in the cap seal according to the present invention, an angle (θ) between the upper inclined surface portion for engagement (11) of the external narrow pressed portion for sealing (10) having the cross section that is the approximate lateral V-shape of the cap seal body (1) and the lower inclined surface portion for engagement (12) of the external narrow pressed portion for sealing (10) is in the 60 to 120° range, preferably, it is in the 95 to 120° range, more preferably, it is in the 100 to 120° range, and further preferably, it is in the 105 to 115° range.

Depending on the open angle (θ) of the external narrow pressed portion for sealing (10) having the cross section that is the approximate lateral V-shape, among two contact points (P) and (Q) between the outward and downward upper inclined surface portion for engagement (11) and the inward and downward lower inclined surface portion for engagement (12) of the external narrow pressed portion for sealing (10) of the cap seal body (1), specifically, the upper contact point (P) is located near the upper end between the upper end of the upper end folding annular external convex portion (31*a*) of the fixed cap part (flange) (31) and the side surface of the most external periphery, and on the other hand, the lower contact point (Q) is located in the middle part between the lower end of the upper end folding annular external convex portion (31*a*) of the fixed cap part (31).

Further, in the case that the angle (θ) between the upper inclined surface portion for engagement (11) of the external narrow pressed portion for sealing (10) and the lower inclined surface portion for engagement (12) of the external narrow pressed portion for sealing (10) is small, for example, it is not more than 95°, for detail, it is in the 60 to 95°, the width of the opening part of the external narrow pressed portion for sealing (10) having the cross section that is the approximate lateral V-shape is made narrow, and at the same time, the top of the lateral V-shape of the external narrow pressed portion for sealing (10) is largely separated outward from the upper end folding annular external convex portion (31*a*) of the fixed cap part (31).

As a result, in such a case, providing a short vertical face portion (its illustration herein omitted) on the external narrow pressed portion for sealing (10), which short vertical surface portion ranging from the lower end of the upper inclined surface portion for engagement (11) that is inclined downward and outward of the external narrow pressed portion for sealing (10) to the upper end of the lower inclined surface portion for engagement (12) that is inclined downward and inward of the external narrow pressed portion for sealing (10), a third contact point (its illustration herein omitted) maybe provided on this vertical surface portion and the side surface on the most external periphery of the upper end folding annular external convex portion (31*a*) of the fixed cap part (31).

In the above description, when the angle (θ) between the upper inclined surface portion for engagement (11) of the external narrow pressed portion for sealing (10) and the lower inclined surface portion for engagement (12) of the external narrow pressed portion for sealing (10) is less than 60°, it becomes difficult for the upper end folding annular external convex portion (31*a*) of the fixed cap part (flange) (31) to put into the external narrow pressed portion for sealing (10) having the cross section that is the approximate lateral V-shape. As a result, the annular drooping wall (4) and the thick portion (5) of the cap seal body (1) are extremely opened outward, and the lower end of the annular drooping wall (4) is separated from the upper surface of the annular step portion (53) of the top panel rising cylinder portion (52). This is not preferable since the sealing function by the cap seal is lost. In addition, when the angle (θ) between the upper inclined surface portion for engagement (11) of the external narrow pressed portion for sealing (10) and the lower inclined surface portion for engagement (12) of the external narrow pressed portion for sealing (10) exceeds 120°, a narrow press power between the upper inclined surface portion for engagement (11) and the lower inclined surface portion for engagement (12) due to the restoring power of the elastic material of the cap seal body (1) is small. This is not preferable since the sufficient sealing effect by the cap seal cannot be executed.

Generally, for example, on the cap part (30) of the top panel (51) of the drum, the so-called inner seal is obtained by the gasket for flange (34) that is placed to the flange portion (32) of the fixed flange (31), and the gasket for a plug (44) that is placed to the lower side of the upper end annular external convex edge part (42) of the plug (41).

Even when sealing of a path, through which the fluid intrudes and the content leaks, between the flange (31) and the circular rising cylinder portion (52) of the top panel (51) is damaged, for example, due to faulty loading of the gasket for flange (34), or sealing of a path, through which the fluid intrudes and the content leaks, between the flange (31) and the plug (41) is damaged, for example, due to a defect such as twist of the gasket for the plug (44), as shown in FIG. 3, according to the cap seal of the present invention, by fitting and applying the cap seal body (1) to the cap part (30) of the drum upon placing of the cap seal, the upper end folding annular external convex part (31*a*) of the fixed cap (a flange) (31) is forcibly fitted to the inside of the narrow pressed portion for external seal (10) having the cross section that is the approximate lateral V-shape of the cap seal body (1) so as to open the cross section that is the approximate lateral V-shape of the narrow pressed portion for external seal (10). Thereby, the upper end folding annular external concave part (31*a*) of the fixed cap (31) is narrowly pressed at two contact points (P) and (Q) by a power of restitution of the elastic material by the outward and downward upper inclined surface portion for engagement (11) and the inward and downward lower inclined surface portion for engagement (12) of the external narrow pressed portion for sealing (10), so that the external sealing is carried out. Thereby, it is possible to inhibit intrusion of external fluid such as rain water and ambient air and leakage of the content of the drum, and this makes it possible to seal the cap part (30) of the drum by the so-called internal and external double sealing.

As a result, according to the cap seal for the drum of the present invention, it is possible not only to prevent rain water accumulated on the upper surface of the top panel of the drum from intruding inside of the drum but also to certainly block the ambient air (humidity and moisture) from the content of the drum, so that a quality of the content cannot be damaged. In addition, it is possible to prevent leakage of the content of the drum lying on its side, and further, no water and no dust are accumulated in the gap between the periphery surface of the gasket for the plug (44) that is placed to the plug (41) and the upper end of the opening part of the flange (31). As a result, the quality of the content of the drum is not damaged by these water and dust.

Thus, after the cap seal according to the present invention is placed, the upper end folding annular external convex portion (31*a*) of the fixed cap part (flange) (31) is narrowly pressed at the two contact points (P) and (Q) by the upper inclined surface portion for engagement (11) that is inclined downward and outward and the lower inclined surface portion for engagement (12) that is inclined downward and inward of the external narrow pressed portion for sealing (10) having the cross section that is the approximate lateral V-shape of the cap seal body (1) due to the restoring power of the elastic material to be brought into contact and be sealed across the entire external periphery of the cap part (30) of the drum. Therefore, the cap seal cannot be easily opened unless it is broken, so that the sealing function can be certainly executed.

Next, as shown in FIGS. 1 to 4, an annular convex portion for attaching a tag (7) is provided on the lower surface of the circular top wall (2) of the cap seal body (1) of the cap seal according to the present invention being protruded downward so as to be located inside of the concave groove for breakage (6*a*) that seems an arc shape from a planar view, and a tag (8) such as the RFID having the information of the drum and its content stored is hanged by the front end portion of this annular convex portion for attaching the tag (7) to be held on the inner surface of the circular top wall (2).

Thereby, it is possible to attach the tag (8) such as the RFID by one touch to the inner surface of the circular top wall (2) of the cap seal body (1) very simply, so that the cap seal can be manufactured simply and economically with an excellent workability.

It is preferable that the tag (8) to be placed to the cap seal is the RFID tag, the IC tag, the QR code (two-dimensional code) display tag, or the bar code display tag.

Here, "RFID" stands for Radio Frequency Identification, and it is a generic name of an authentication (recognition) technique using radio waves, however, combination of non-contact communication by radio waves and the authentication using IC chips is becoming mainstream. Therefore, "RFID" is used as a word meaning "a noncontact authentication technique using IC chips".

According to the present invention, by holding such tags, and the RFID that is the IC chip with an antenna, which is processed into a label on the inner surface of the circular top wall (2) of the cap seal body (1) of the cap seal of the drum, and reading the information stored therein by means of an apparatus called as a reader and writer, the authentication of each drum is carried out.

On the tag (8) such as the RFID tag, for example, a name of product of the content of the drum, a name of a raw material (the information about the content), the internal content (for example, 200 L), a production lot No., a date of packing, an expiration date, a method of preservation (a temperature control, an oscillation control), a method of transportation (an oscillation control, position management), an actual producer, a selling agency, and other information are stored. According to a physical distribution management system using the cap seal of the present invention including the tag (8) such as the RFID tag, it is possible to grasp all information from production (filling) to selling of the content of the drum by a related department timely, so that it is possible to carry out management such as a quality control, a commodity management, the control of entering and dispatching from warehouse, and position management of the content of the container, for example, by GPS very promptly, optimally, and certainly.

Further, when attaching the tag (8) such as the RFID tag on the inner surface of the circular top wall (2) of the cap seal body (1) of the cap seal, it is necessary that the cap seal body (1) is made of a synthetic resin such as a polyethylene resin since the cap seal body (1) should be an object capable of conducting radio waves.

In addition, when attaching the QR code display tag or the bar code display tag, the circular top wall (2) of the cap seal body (1) made of a resin is needed to be transparent in order to read these codes.

In order to remove the cap seal when using the content of the drum after the cap part (30) of the drum is sealed by the cap seal according to the present invention, there is no alternative but to break this.

Figure 6:
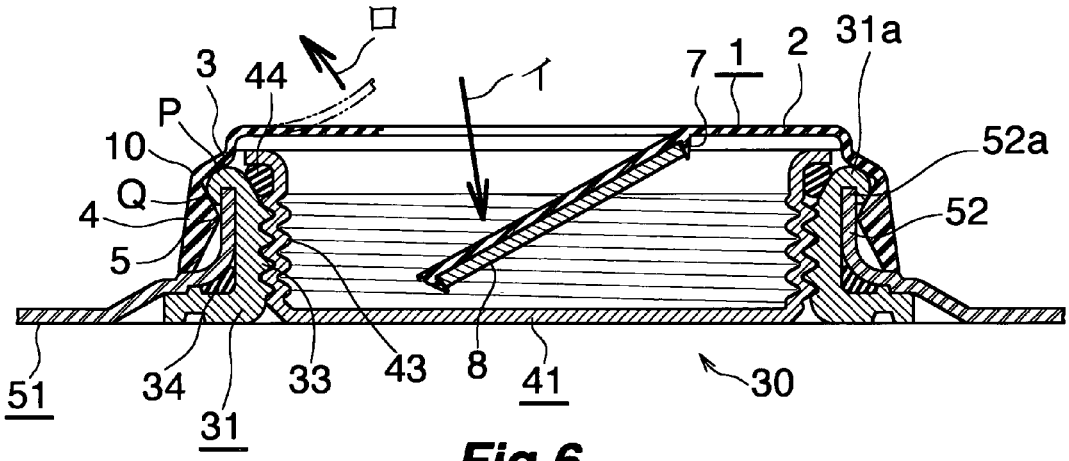
FIG. 6 is a longitudinal sectional view of the whole cap part showing the state of opening the cap part of the drum with the cap seal according to the present invention placed.

As shown in FIG. 6, when opening the cap part (30) of the drum that is sealed by the cap seal according to the present invention, at first, by hitting a center part of the main portion of the concave groove for breakage (6*a*) that seems a notched circle from a planar view formed on the circular top wall (2) of the cap seal body (1), for example, with a tool such as a hammer, this notched circle-shaped concave groove for breakage (6*a*) is broken in a direction of an arrow (a).

Subsequently, pulling a part of the circular top wall (2) of the cap seal body (1) between two auxiliary portions of the concave groove for breakage (6*c*) that are continued to the left arc portion of this notched circle-shaped concave groove for breakage (6*a*) up to a direction of an arrow (b), for example, by a tool such as a pincher (its illustration herein omitted), the remaining part of the circular top wall (2) of the cap seal body (1) is broken along two auxiliary portions of the concave groove for breakage (6*c*). As a result, the cap seal body (1) is lifted to be removed and be opened.

As a result, it is possible to open the cap seal of the present invention simply and certainly, and further, the present cap seal can be handled very easily.

Figure 7:
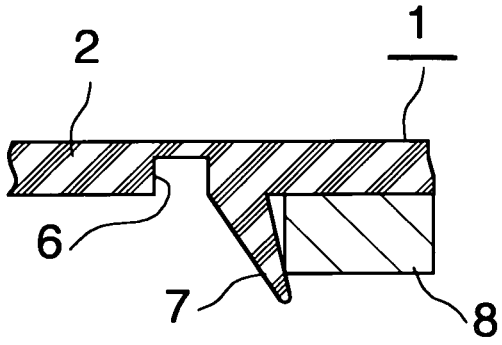
FIG. 7A is an enlarged sectional view of a concave groove portion for breaking a top wall of the cap seal.
FIG. 7B is a partial enlarged sectional view showing a first modified example of this concave groove portion for breaking the top wall.
FIG. 7C is a partial enlarged sectional view showing a second modified example of this concave groove portion for breaking the top wall.
Figure 7:
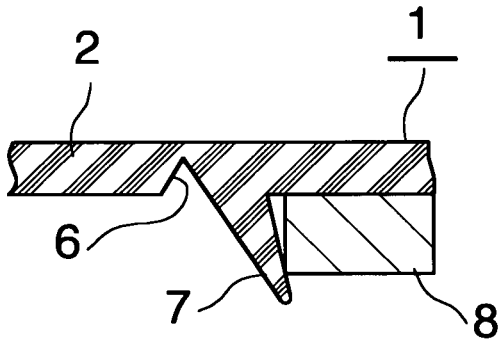
Figure 7:
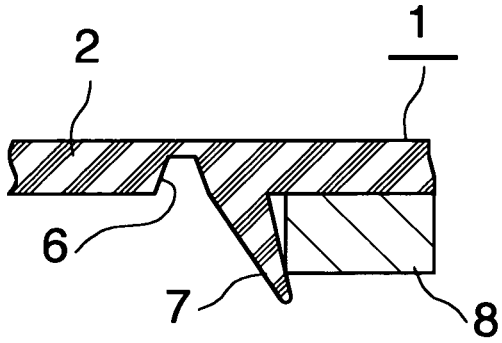

As shown in FIG. 7A, the concave grooves for breakage (6) that are provided on the circular top wall (2) of the cap seal body (1), namely, the main portion of the concave groove for breakage (6*a*) that seems a notched circle from a planar view; the sub portions of the concave groove for breakage (6*b*) that are extended in parallel from the opposite ends to the right side of the main portion of the concave groove for breakage (6*a*); and two auxiliary portions of the concave groove for breakage (6*c*) that are extended in parallel to the left side from the left arc portion of the main portion of the concave groove for breakage (6*a*) that seems a notched circle from a planar view have cross sections that are approximate angular groovy shapes, respectively.

However, other than this shape, these concave grooves for breakage (6) may have approximate lateral V-shape cross sections as shown in FIG. 7B or may have approximate lateral trapezoidal cross sections as shown in FIG. 7C or the like; and the cross sectional shapes of the concave grooves for breakage (6) that are provided on the circular top wall (2) of the cap seal body (1) are not limited to the illustrated shapes.

Further, according to the above-described embodiment, although these concave grooves for breakage (6) are provided on the inner surface of the circular top wall (2) of the cap seal body (1), the concave grooves for breakage (6) maybe provided on the outer surface of the circular top wall (2) of the cap seal body (1).

In addition, the planar shapes of the main portion of the concave groove for breakage (6*a*), the sub portions of the concave groove for breakage (6*b*), and the auxiliary portions of the concave groove for breakage (6*c*) of the circular top wall (2) of the cap seal body (1) are not limited to the illustrated shapes, and in other words, a shape that can break and remove the cap seal body (1) upon opening of the cap seal may be available.

Further, according to the present embodiment, the annular convex portion for attaching the tag (7) is provided so as to be positioned on the inner surface of the concave groove for breakage (6*a*) that seems an arc from a planar view; however, such a concave portion for attaching the tag (7) may not be an annular shape; and plural convex portions for attaching the tag, preferably, 2 to 5 pieces of the convex portions for attaching the tag may hold the peripheral edge portions of the tag such as the RFID tag.

In addition, according to the present embodiment, the illustrated RFID tag is formed in a circular shape; however, not limited to this, the tag (8) may be formed in a square shape, an oval shape, and other shapes, and particularly, the QR code display tag and the barcode display tag are formed in a square shape in many cases.

In addition, the tag (8) such as the RFID tag, the IC tag, the QR code display tag, or the barcode display tag may be attached on the inner surface of the circular top wall (2) of the cap seal body (1) by adhesive means and the like.

Further, the tag (8) is not limited to the above, and as the tag (8), the tag having a quality of the content of the drum, a name of a manufacturing company, a name of a sales company, and a mark or the like printed may be available, and by means of these tags (8), quality certification of the content of the drum can be obtained.

In the doubly-sealing apparatus of the drum using the cap seal according to the present invention, the internal periphery surface of the annular step portion (3) that is continued to a peripheral edge portion of the circular top wall (2) of the cap seal body (1), which is made of an elastic material and is fitted and applied to the cap part (30) having the inner seal portion of the drum, is formed as the upper inclined surface portion for engagement (11) that is inclined downward and outward; the thick portion (5) that is protruded inward is formed on the inside of the annular drooping wall (4) that is continued to the external peripheral edge of the annular step portion (3); the internal periphery surface of the upper half part of the thick portion (5) is formed as the lower inclined surface portion for engagement (12) that is inclined downward and inward; the external narrow pressed portion for sealing (10) having the cross section that is the approximate lateral V-shape is formed by the upper inclined surface portion for engagement (11) that is inclined downward and outward within the annular step portion (3) and the lower inclined surface portion for engagement (12) that is inclined downward and inward within the upper half part of the thick portion (5); the internal periphery surface of the lower half part of the thick portion (5) is formed as the guide inclined surface portion (13) which is inclined downward and outward; and the cap seal body (1) is pressed and applied to the cap part (30) of the drum. Thus, the upper end folding annular external convex part (31*a*) of the fixed cap (31) is fitted so as to open the cross section that is the approximate lateral V-shape of the narrow pressed portion for external seal (10). Thereby, the upper end folding annular external concave part (31*a*) of the fixed cap (31) is narrowly pressed at two contact points (P) and (Q) by a power of restitution of the elastic material by the outward and downward upper inclined surface portion for engagement (11) and the inward and downward lower inclined surface portion for engagement (12) of the external narrow pressed portion for sealing (10), so that the external sealing is carried out. Thus, upon opening of the cap seal, by breaking the cap seal body (1) along the concave groove for breakage (6) provided on the circular top wall (2) of the cap seal body (1), the cap seal is opened.

According to the above-described double sealing apparatus of the drum using the cap seal according to the present invention, the internal and external double sealing of the drum can be fully performed despite of various errors such as the difference in the curling external diameter of the cap part of the drum, the measurement difference in the curling external diameter of the curling part of the press flange placing apparatus, or the difference of the sheet thickness in the rising cylindrical portion of the top panel (the attachment portion of the press flange), and the difference of the sheet thickness in the folding front end (the curling part) of the press flange.

Therefore, according to the double sealing apparatus of the drum using the cap seal of the present invention, it is possible to certainly block ambient air (humidity and moisture) from the content of the drum so as to prevent a quality of the content from being damaged.

In addition, when opening the cap part of the drum, the cap seal body is broken along a concave groove for breakage that is provided on the circular top wall of this to open the cap seal, so that it is possible to open the cap seal very simply and reliably, they can be handled very easily, and a reliable sealing function can be obtained.

Figure 8:
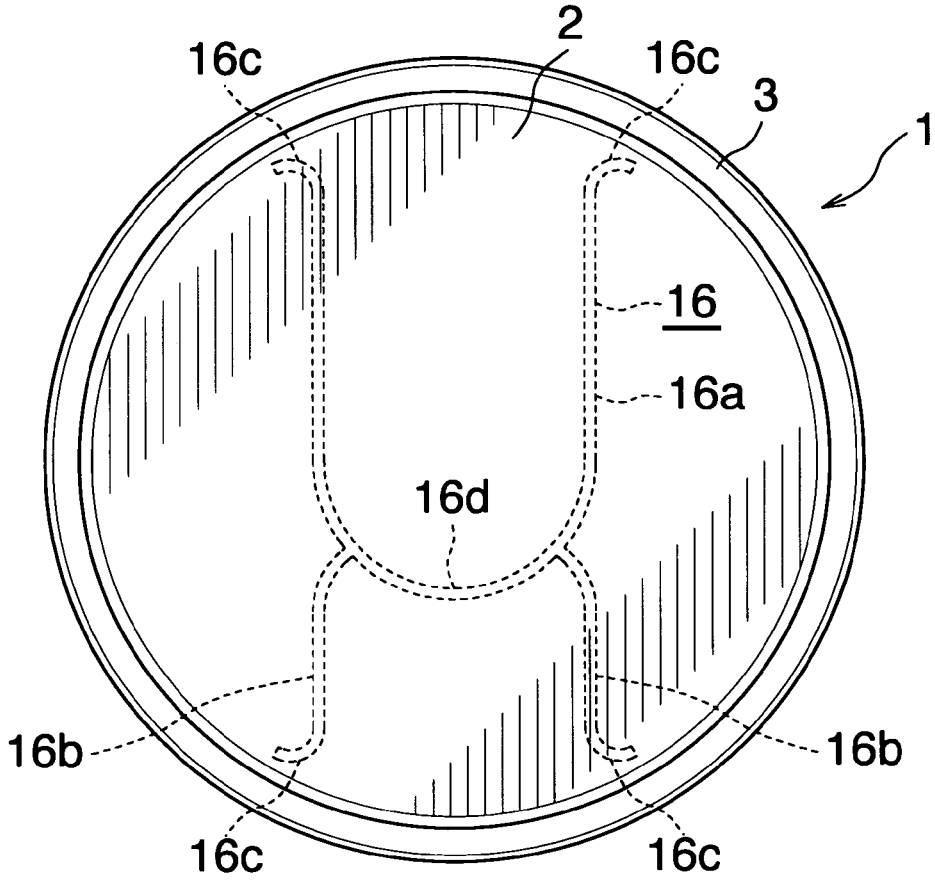
FIG. 8 is a plan view showing another example of the cap seal according to the present invention, which shows the whole cap seal.

FIG. 8 shows another example of the cap seal of the drum according to the present invention. Here, this example is different from the above-described cap seals shown in FIG. 1 and FIG. 2 in that the shape of a concave groove for breakage (16) that is provided on the circular top wall (2) of the cap seal body (1).

In other words, the circular top wall (2) of the cap seal body (1) is provided with a main portion of the concave groove for breakage (16*a*) that seems an approximate U-shape from a planar view, and two sub portions of the concave groove for breakage (16*b*) that are extended in an approximate parallel from the opposite ends of an arc portion (16*d*) of the main portion of the concave groove for breakage (16*a*) to the opposite directions. Then, sub portions of the concave groove for breakage (16*c*) folded outward are provided on the opposite end portions of the main portion of the concave groove for breakage (16*a*) that seems an approximate U-shape from a planar view, respectively; and the sub portions of the concave groove for breakage (16*c*) folded outward are also provided on the opposite end portions of the sub portions of the concave groove for breakage (16*b*) that are extended in an approximate parallel to the opposite directions, respectively.

When opening the cap part (30) of the drum that is sealed by the cap seal according to the present invention, at first, by hitting the center part of the arc part (16*d*) of the main portion of the concave groove for breakage (16*a*) that seems an approximate U-shape from a planar view formed on the circular top wall (2) of the cap seal body (1), for example, with a tool such as a hammer, this arc part (16*d*) of the main portion of the concave groove for breakage (16*a*) is broken (for example, refer to an arrow a of FIG. 6).

Subsequently, pulling a part of the circular top wall (2) between two auxiliary portions of the concave groove for breakage (16*b*) that are continued to the opposite sides of the arc portion (16*d*) of the main portion of the concave groove for breakage (16*a*) formed in the approximate U-shape, for example, by a tool such as a pincher (its illustration herein omitted), the remaining part of the circular top wall (2) of the cap seal body (1) is broken along two auxiliary portions of the concave groove for breakage (16*b*) (for example, refer to an arrow b of FIG. 6). As a result, the cap seal body (1) is lifted to be removed and be opened.

Accordingly, it is possible to open the cap seal of the present invention simply and certainly, and further, the present cap seal can be handled very easily.

Further, in the cap seal of FIG. 8, the sub portions of the concave groove for breakage (16*c*) folded outward are provided on the opposite end portions of the main portion of the concave groove for breakage (16*a*) that seems an approximate U-shape from a planar view, respectively; and the sub portions of the concave groove for breakage (16*c*) folded outward are also provided on the opposite end portions of the sub portions of the concave groove for breakage (16*b*) that are extended in an approximate parallel to the opposite directions, respectively. Therefore, the interval between the opposite front end portions of the main portion of the concave groove for breakage (16*a*) formed in the approximate U-shape is made wide, and the interval between the opposite front end portions of the sub portions of the concave groove for breakage (16*b*) is also made wide. Accordingly, when opening the cap seal, it is prevented that a part of the circular top wall (2) between the sub portions of the concave groove for breakage (16*b*) that are pulled up by a tool such as a pincher (its illustration herein omitted) is cut from the part continued to the remaining part of the circular top wall (2), particularly, the part continued to the annular step portion (3), and the cap seal body (1) is left on the side of the cap part (30) of the drum. Therefore, it is possible to certainly carry out the opening operation of the cap part (30) of the drum that is sealed by the cap seal.

Figure 9:
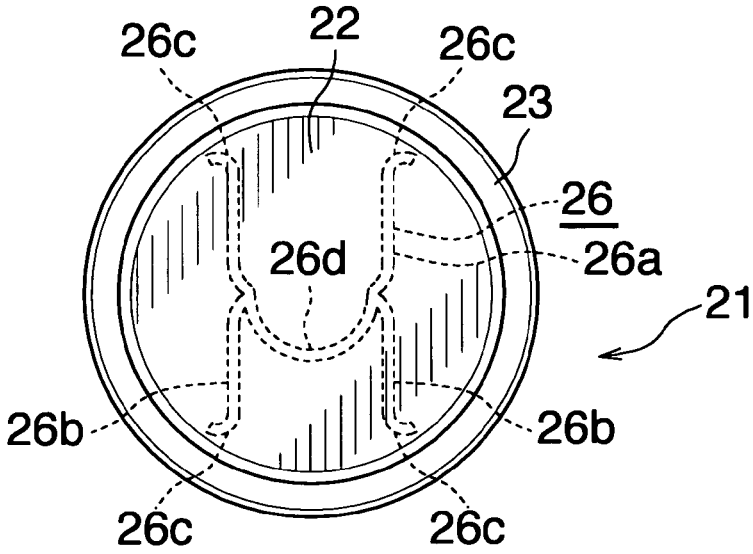
FIG. 9 is a plan view of the cap seal according to the present invention to be placed to a small diameter cap part of the drum.

FIG. 9 shows an embodiment that the cap seal according to the present invention is applied to a small diameter cap part of the drum.

In FIG. 9, on the inner surface of a circular top wall (22) of a cap seal body (21) of the cap seal that is fitted and applied to the small diameter cap part of the drum according to the present invention, a concave groove for breakage (26) is provided, which is opened downward and has an approximate angular groovy shaped cross section. The shape of this concave groove for breakage (26) is the same as the case of the cap seal show in FIG. 8.

In other words, the circular top wall (22) of the cap seal body (21) is provided with a concave groove for breakage (26*a*) that seems an approximate U-shape from a planar view, and two sub portions of the concave groove for breakage (26*b*) that are extended in an approximate parallel from the opposite ends of an arc portion (26*d*) of the main portion of the concave groove for breakage (26*a*) to the opposite directions. Then, sub portions of the concave groove for breakage (26*c*) folded outward are provided on the opposite end portions of the concave groove for breakage (26*a*) that seems an approximate U-shape from a planar view, respectively; and the sub portions of the concave groove for breakage (26*c*) folded outward are also provided on the opposite end portions of the sub portions of the concave groove for breakage (26*b*) that are extended in an approximate parallel to the opposite directions, respectively.

When opening the cap part (30) of the drum that is sealed by the cap seal according to the present invention, at first, by hitting the center part of the arc part (26*d*) of the main portion of the concave groove for breakage (26*a*) that seems an approximate U-shape from a planar view formed on the circular top wall (22) of the cap seal body (21), for example, with a tool such as a hammer, this arc part (26*d*) of the main portion of the concave groove for breakage (26*a*) is broken (for example, refer to an arrow a of FIG. 6).

Subsequently, pulling a part of the circular top wall (22) between two auxiliary portions of the concave groove for breakage (26*b*) that are continued to the opposite sides of the arc portion (26*d*) of the main portion of the concave groove for breakage (26*a*) formed in the approximate U-shape, for example, by a tool such as a pincher (its illustration herein omitted), the remaining part of the circular top wall (22) of the cap seal body (21) is broken along two auxiliary portions of the concave groove for breakage (26*b*) (for example, refer to an arrow b of FIG. 6). As a result, the cap seal body (21) is lifted to be removed and be opened.

Accordingly, it is possible to open the cap seal of the present invention simply and certainly, and further, the present cap seal can be handled very easily.

Further, in the cap seal of FIG. 9, the sub portions of the concave groove for breakage (26*c*) folded outward are provided on the opposite end portions of the main portion of the concave groove for breakage (26*a*) that seems an approximate U-shape from a planar view, respectively; and the sub portions of the concave groove for breakage (26*c*) folded outward are also provided on the opposite end portions of the sub portions of the concave groove for breakage (26*b*) that are extended in an approximate parallel to the opposite directions, respectively. Therefore, the interval between the opposite front end portions of the main portion of the concave groove for breakage (26*a*) formed in the approximate U-shape is made wide, and the interval between the opposite front end portions of the sub portions of the concave groove for breakage (26*b*) is also made wide. Accordingly, when opening the cap seal, it is prevented that a part of the circular top wall (22) between the sub portions of the concave groove for breakage (26*b*) that are pulled up by a tool such as a pincher (its illustration herein omitted) is cut from the part continued to the remaining part of the circular top wall (22), particularly, the part continued to the annular step portion (23), and the cap seal body (1) is left on the side of the cap part (30) of the drum. Therefore, it is possible to certainly carry out the opening operation of the cap part (30) of the drum that is sealed by the cap seal.

Further, although the illustration is herein omitted, each of the cap seals according to the present invention shown in FIG. 8 and FIG. 9 also has an annular convex part for attaching a tag (7) with a small diameter, which is provided being protruded downward on the lower surface of the circular top wall (2) or (22) of the cap seal body (1) or (21) so as to be positioned inside of the arc portion (16*d*) or (26*d*) of the concave groove for breakage (16*a*) or (26*a*) that seems the approximate U-shape from a planar view. In this case, a tag (8) such as the RFID tag having the information about the drum and the content of the drum stored may be hanged on the front end portion of this annular convex part for attaching the tag (7) to be held by the inner surface of the circular top wall (2) or (22). Other points are the same as the case of the above-described cap seal according to the present invention shown in FIGS. 1 to 7.

In addition to the drum, the cap seal according to the present invention and the double-sealing apparatus using the same may be applied to a container such as a gallon can that is similar to the drum.

What is claimed is:

1. A cap seal of a container such as a drum comprising a cap seal body made of an elastic material, which is fitted and applied to a cap part having an inner seal portion of a container such as a drum, wherein the cap seal body having:

a cap seal having a circular top wall;

a concave groove for breakage that is provided on the circular top wall;

an annular step portion inclined relative to the circular top wall attached to a peripheral portion of the circular top wall; and an annular drooping wall attached to an external periphery of the annular step portion;

wherein: an internal periphery surface of the annular step portion is formed as an upper inclined surface portion for engagement that is inclined downward and outward relative to the circular top wall; on the inside of the annular drooping wall, a thick portion that is protruded inward is provided; and an internal periphery surface of the upper half part of the thick portion is formed as a lower inclined surface portion for engagement that is inclined downward and inward relative to the circular top wall so that the upper inclined surface portion of the annular step portion and the lower inclined surface portion of the thick portion are adjacent and opposing to form an external narrow pressed portion for sealing having a cross section that is an approximate lateral V-shape is formed by the upper inclined surface portion for engagement that is inclined downward and outward, relative to the circular top wall, on the inside of the annular step portion and the lower inclined surface portion for engagement that is inclined downward and inward, relative to the circular top wall, located on the inside of the upper half part of the thick portion;

the internal periphery surface of the lower half part of the thick portion is formed as a guide inclined surface portion for fitting and covering that is inclined downward and outward;

when the cap seal being placed, by covering the cap part of the container such as the drum with the cap seal body, an upper end folding annular external convex part of a fixed cap is forcibly fitted into the inside of the external narrow pressed portion for sealing having the cross section that is the approximate lateral V-shape of the cap seal body so as to open the cross section that is the approximate lateral V-shape of the external narrow pressed portion for sealing;

thereby, the upper end folding annular outward convex portion of the fixed cap is narrowly pressed at two contact points by a power of restitution of the elastic material by the outward and downward upper inclined surface portion for engagement and the inward and downward lower inclined surface portion for engagement of the external narrow pressed portion for sealing, so that the external sealing is carried out; and upon opening of the cap seal, the cap seal body is broken along a concave groove for breakage that is provided on the circular top wall of this to open the cap seal, wherein a concave groove for breakage that is provided on the circular top wall of the cap seal body comprising:

a concave groove for breakage that is an approximate U-shape from a planar view, and two sub portions of the concave groove for breakage that are extended in an approximate parallel from the opposite ends of an arc portion of the main portion of the concave groove for breakage to the opposite directions;

wherein, sub portions of the concave groove for breakage folded outward are provided on the opposite end portions of the concave groove for breakage that is an approximate U-shape from a planar view, respectively; and the sub portions of the concave groove for breakage folded outward are also provided on the opposite end portions of the sub portions of the concave groove for breakage that are extended in an approximate parallel to the opposite directions, respectively.

2. The cap seal of the container such as the drum according to claim 1, wherein a concave groove for breakage that is provided on the circular top wall of the cap seal body comprises a main portion of the concave groove for breakage that is a notched circle from a planar view and sub portions of the concave groove for breakage that are extended toward the annular step portion of the cap seal body from the opposite ends of the main portion of the concave groove for breakage.

3. The cap seal of the container such as the drum according to claim 1;

wherein the elastic material forming the cap seal body is a synthetic resin, elastomer, or a synthetic rubber.

4. The cap seal of the container such as the drum according to claim 1;

wherein the cap seal body is made of a synthetic resin, and on the inner surface of the circular top wall of the cap seal body, a tag such as an RFID tag having the information about the content of the container such as the drum stored is attached.

5. The cap seal of the container such as the drum according to claim 4, wherein a projection for attaching a tag is provided on the inner surface of the circular top wall of the cap seal body, and a tag such as an RFID tag having the information about the content of the container such as the drum stored is hanged by this projection to be held on the inner surface of the circular top wall.

6. The cap seal of a container such as the drum according to claim 4, wherein a tag is the RFID tag having the information about the content of the container such as the drum stored, the IC tag, the QR code display tag, or the bar code display tag.

* * * * *